US009296201B2

(12) United States Patent
Westby

(10) Patent No.: US 9,296,201 B2
(45) Date of Patent: Mar. 29, 2016

(54) INK FOUNTAIN APPARATUS AND METHOD OF ADJUSTING INK FLOW FOR A FLEXOGRAPHIC PRINTING APPARATUS

(71) Applicant: PROBITY ENGINEERING, LLC, Milaca, MN (US)

(72) Inventor: Ronald K. Westby, Princeton, MN (US)

(73) Assignee: Probity Engineering, LLC, Milaca, MN (US)

( * ) Notice: Subject to any disclaimer, the term of this patent is extended or adjusted under 35 U.S.C. 154(b) by 0 days.

(21) Appl. No.: 14/207,460

(22) Filed: Mar. 12, 2014

(65) Prior Publication Data

US 2014/0261034 A1 Sep. 18, 2014

Related U.S. Application Data

(60) Provisional application No. 61/779,612, filed on Mar. 13, 2013.

(51) Int. Cl.
*B41F 31/05* (2006.01)
*B41F 31/04* (2006.01)
*B41F 5/24* (2006.01)

(52) U.S. Cl.
CPC . *B41F 31/04* (2013.01); *B41F 5/24* (2013.01); *B41F 31/05* (2013.01)

(58) Field of Classification Search
CPC ..... B41F 31/04; B41F 31/05; B41F 31/02; B41F 5/24; B41F 9/1072; B41F 9/10; B41F 9/08; B41F 9/1036
See application file for complete search history.

(56) References Cited

U.S. PATENT DOCUMENTS

| | | | | |
|---|---|---|---|---|
| 2,151,968 | A * | 3/1939 | Henderson | 101/157 |
| 4,133,293 | A * | 1/1979 | Smejda | 118/411 |
| 4,454,810 | A | 6/1984 | Matsumoto | |
| 4,513,662 | A | 4/1985 | Schneider | |
| 4,559,871 | A | 12/1985 | Kutzner et al. | |
| 4,584,941 | A | 4/1986 | Weber | |
| 4,590,855 | A | 5/1986 | Schommer et al. | |
| 4,796,528 | A | 1/1989 | Sarazen | |
| 4,821,672 | A | 4/1989 | Bruno | |

(Continued)

FOREIGN PATENT DOCUMENTS

| | | |
|---|---|---|
| DE | 2646071 C2 | 6/1985 |
| DE | 4241792 A1 | 6/1994 |

OTHER PUBLICATIONS

Search Report and Written Opinion for PCT/US2014/25101, dated Sep. 15, 2014, 16 pages.

*Primary Examiner* — Matthew G Marini
*Assistant Examiner* — Leo T Hinze
(74) *Attorney, Agent, or Firm* — Skaar Ulbrich Macari, P.A.

(57) ABSTRACT

An ink fountain apparatus, method of method of adjusting printing characteristics in flexographic printing and a printing press system are disclosed. The apparatus may include a side plate, a roller disposed adjacent a first end of the plate, a back plate disposed adjacent a second opposing end of the side plate and a throttle disposed between the roller and the back plate. The throttle is mounted to the side plate and includes a back surface facing towards the back plate and a front surface facing towards the roller. The front surface includes a curved portion forming a tapering gap between the roller and the front surface of the throttle. A position controller is coupled to the throttle to selectively move the curved portion towards and away from the roller to adjust the volume of ink being transferred to the outer surface of the roller.

19 Claims, 8 Drawing Sheets

(56) References Cited

U.S. PATENT DOCUMENTS

| | | | | |
|---|---|---|---|---|
| 4,982,660 | A | 1/1991 | Hamm et al. | |
| 5,044,277 | A | 9/1991 | John | |
| 5,081,928 | A | 1/1992 | Harrison | |
| 5,125,341 | A | 6/1992 | Yaeso | |
| 5,150,651 | A | 9/1992 | Flores | |
| 5,182,992 | A | 2/1993 | Rogge | |
| 5,213,037 | A | 5/1993 | Leopardi, II | |
| 5,239,925 | A | 8/1993 | Bobo | |
| 5,289,772 | A | 3/1994 | Kohara et al. | |
| 5,410,961 | A | 5/1995 | DeNicola et al. | |
| 5,425,809 | A | 6/1995 | Person | |
| 5,443,004 | A | 8/1995 | Kohara et al. | |
| 5,477,782 | A | 12/1995 | Nguyen | |
| 5,497,702 | A | 3/1996 | Gorter | |
| 5,628,250 | A | 5/1997 | Weisbrod | |
| 5,957,051 | A | 9/1999 | Atwater | |
| 5,983,797 | A | 11/1999 | Secor | |
| 6,119,595 | A | 9/2000 | Garris et al. | |
| 6,210,757 | B1 * | 4/2001 | Taylor et al. | 427/356 |
| 6,393,983 | B1 * | 5/2002 | Iijima et al. | 101/350.1 |
| 7,007,604 | B2 * | 3/2006 | Momot | 101/366 |
| 7,275,482 | B2 | 10/2007 | Westby | |
| 7,281,473 | B2 | 10/2007 | Westby et al. | |
| 7,287,472 | B2 | 10/2007 | Rogge et al. | |
| 7,337,720 | B2 | 3/2008 | Ross et al. | |
| 8,006,616 | B2 | 8/2011 | Kleinschnitz et al. | |
| 8,539,880 | B2 | 9/2013 | Westby | |
| 8,973,497 | B2 | 3/2015 | Westby | |
| 2005/0089662 | A1 | 4/2005 | Bayzelon et al. | |
| 2006/0081141 | A1 | 4/2006 | Deneka | |
| 2010/0326301 | A1 | 12/2010 | Dedman | |
| 2013/0000501 | A1 | 1/2013 | Westby | |

* cited by examiner

INK FOUNTAIN APPARATUS AND METHOD OF ADJUSTING INK FLOW FOR A FLEXOGRAPHIC PRINTING APPARATUS

PRIORITY

This application claims the priority benefit of U.S. Provisional Application No. 61/779,612 filed on Mar. 13, 2013, which is hereby incorporated herein by reference in its entirety.

FIELD

The present invention relates generally to flexographic printing devices, and more particularly, to a laminar ink extruder for a flexographic printing press and a method for supplying ink to an in transferring roller thereof.

BACKGROUND

Conventional flexographic printing presses and methods involve six major components; ink well, ink, ink applicator called an inking roll, ink dispenser called an anilox, image plate called a photopolymer plate and print material referred to as the substrate.

The inking roll is a rubber cylinder that rotates in the ink well, which is filled with ink. By capillary action, the ink adheres to the surface of the rubber cylinder. As the inking roller continues to rotate it will encounter the anilox roller. As the two cylindrical surfaces contact each other (rolling pinch), ink is forced into the rough outer surface of the anilox, thereby filling the voids (called cells) with ink. The anilox in turn rotates to carry its ink laden surface towards a doctor blade that mechanically scrapes into the face of the anilox in a shearing-like action. This doctor blade, referred to as a leading edge doctor blade cuts into the ink at the surface of the anilox removing all ink except what remains below the anilox rough surface (in the cells). The action of the doctor blade causes wear and eventual failure of the anilox.

As the anilox continues its rotation, the cells loaded with ink approach the photopolymer plate, which is mounted on its own rotating cylinder. As the two surfaces of the anilox and plate contact each other (rolling nip), the image plate contacts the ink in the anilox's cells and, again via capillary action, lifts the ink from the cells.

The ink laden photopolymer plate continues its rotation until it contacts the substrate and transfers its ink to the substrate to make an impression (image) on the substrate corresponding to the image defined in the plate.

Persons skilled in the flexographic printing art understand that the anilox roll is a key component of the printing press. It is critical that the anilox operate in an optimum manner since it receives and dispenses ink in specific volumes to control color and quality of the printed product.

The conventional anilox roller comprises a steel cylinder with ceramic material bonded to its outside circumferential surface. The ceramic surface is also laser engraved with precise, microscopic indentations, called cells. These cells, when filled, dispense ink to the photopolymer plate. The photopolymer plates receive ink in amounts according to the volume in each cell. Different cell sizes correspond to different amounts of ink that can be transferred to the plate. Also, the ceramic material is brittle, easily damaged and its cell volume cannot be changed. Thus, each printing press typically requires a large library or inventory of anilox rollers. Establishing and maintaining such a library is very expensive. Moreover, the life expectancy of a given anilox roller is short, so many replacement rollers must be purchased, thereby adding to costs.

There are several additional printing difficulties related to the Anilox rollers discussed above, including:

1. The ink well supplying ink to the anilox cylinder is open to the air, allowing ink additives to vaporize off during a production run. This requires continuous monitoring of ink quality to prevent an ink color shift.
2. Each printing press requires a large library of individual anilox rollers, each of which have numerous cell volumes and line count combinations to complete the full library for each press. It is a steep financial hurdle to establish and maintain an anilox roller library having all possible combinations. As a result, the press operator is forced to compromise manufacturing design by using the closest anilox available in the operator's library, often with deficient results.
3. Due to the huge cost of aniloxes, it is custom to share aniloxes between presses, this complicates work scheduling when two presses may need the same anilox at the same time. The aniloxes also degrade faster because of increased use time.
4. When the printer wishes to set up a new order, each anilox from the previous order must be removed for cleaning, and/or placed in storage. The aniloxes for the new order are then selected from storage and installed in the press. This contributes to press down time. Often, on short order runs, it will take longer to set up the press with new aniloxes, than it does to print the work ordered.
5. Anilox surfaces are most often made of ceramic, and are extremely fragile. A simple bump or pressure from fingers can destroy an anilox surface. Often, damage from removal and rough use destroys the anilox before it can wear out. The more frequently an anilox is exchanged the shorter its life expectancy is.
6. Mixing ink for a press is a challenge. Chemical engineering aspects and color technology must all be correct for predictable use. Mixing ink accurately is not easy, in fact, bad ink on a press occurs at a rate exceeding 30% of the time. If the ink formula cannot be changed, the anilox volume will need to be changed by replacing it. This change over consumes valuable production time.

There have been numerous attempts to control ink flow to account for worn anilox rollers and/or anilox rollers with less than ideal characteristics for a given print job. These attempts focus on providing volume control of the ink flow dispensed to an ink roller by controlling the opening of the supply port to the ink roller. But such attempts have been less than ideal because they do not address the necessary ink delivery (control) management, or the even distribution of the ink at the anilox roller gap point. As a result, there is a continuing need to provide for an improved ink fountain apparatus and method for distributing ink to the anilox roller.

SUMMARY

The present addresses the problems discussed above by providing an ink fountain apparatus and method of distributing ink to a roller configured to transfer ink to a photopolymer plate. Certain example embodiments include an ink fountain apparatus, a method of adjusting printing characteristics in flexographic printing and a printing press system.

An example ink fountain apparatus may include a side plate, a roller disposed adjacent a first end of the plate, a back plate disposed adjacent a second opposing end of the side plate and a throttle disposed between the roller and the back plate. The throttle is rotatably mounted to the side plate and includes a back surface facing towards the back plate and a front surface facing towards the roller. The front surface includes a curved portion forming a tapering gap between the roller and the front surface of the throttle. A position controller is coupled to the throttle to selectively move the curved portion towards and away from the roller to adjust the volume of ink being transferred to the outer surface of the roller.

An example method of adjusting printing characteristics in flexographic printing includes applying ink to an outer surface of an ink transferring roller and contacting the outer surface of the ink transferring roller having received ink with a flexographic plate mounted on a plate cylinder. An ink quality characteristic is measured. The ink throttle member is moved with respect to the outer surface of the ink transferring roller to adjust a volume of ink being deposited on the outer surface of the ink transferring roller by opening or closing a tapered gap formed between a front surface of the throttle member and the outer surface of the ink transferring roller.

An example flexographic printing press system includes a processor controlled ink fountain apparatus. The ink fountain apparatus includes an ink roller and an ink throttle disposed adjacent the ink roller, the ink throttle being movable with respect to the ink roller, and forming an adjustable tapered gap between the ink roller and the throttle. An ink dispenser is configured to deliver a volume of ink to the tapered gap through an ink conduit. A plate roller includes a flexographic plate disposed on an outer surface thereof. The plate roller is located adjacent the ink fountain apparatus such that the plate dips into the ink on the roller surface to transfer the ink from the ink roller to the plate. An impression cylinder is disposed adjacent the plate roller to support a substrate fed between the plate roller and the impression cylinder while the substrate received an ink image from the plate contacting the substrate. A scanner apparatus is configured to read an image quality characteristic of the ink image. A processor is coupled to the scanner apparatus and to the ink fountain apparatus. The processor is configured to compare the image quality characteristic read by the scanner against a target value for the image quality characteristic and to move the throttle with respect to the ink roller to change the tapered gap between the ink roller and the throttle.

Benefits of certain embodiments of the apparatus, system and method may include one or more of the following:

a. Ink exposure to air is reduced because it is not necessary to have an open-bath ink well.
b. Fewer numbers of anilox or transfer rollers are required in a given library because the ink adjustability is provided by the ink fountain apparatus of the invention, rather than the characteristics of an anilox roller.
c. Anilox roller life can be greatly extended because ink flow characteristics can be adjusted (e.g. increased) to accommodate for a worn anilox surface. Also, elimination of a doctor blade eliminates the associated scraping action on the anilox surface, which greatly reduces wear.
d. Capital expenditures are reduced due to the smaller anilox library requirements and longer useful anilox life.
e. Reduction in the frequency of necessary anilox roller changes reduces downtime and reduces the likelihood that the anilox would be damaged during an exchange.
f. Mis-mixes of the ink can be compensated for by adjusting the print characters with the invention instead of swapping anilox rollers and/or cleaning the press and re-mixing the ink.

The above summary of the invention is not intended to describe each illustrated embodiment or every implementation of the invention. The figures in the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
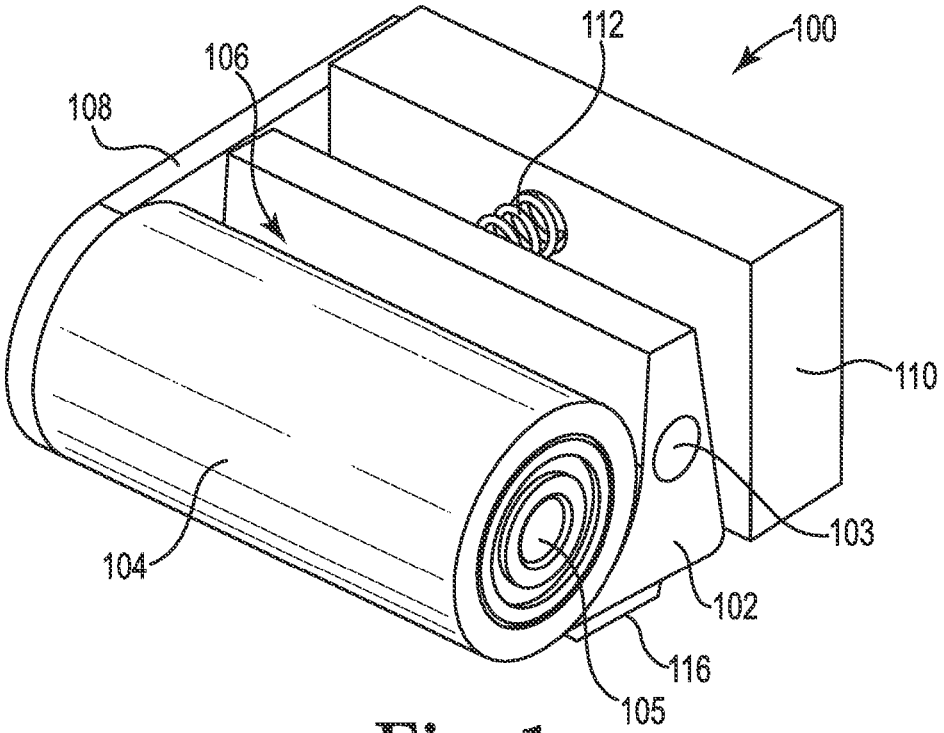
FIG. 1 is a perspective view of an ink fountain apparatus in accordance with certain embodiments of the present invention.
Figure 2:
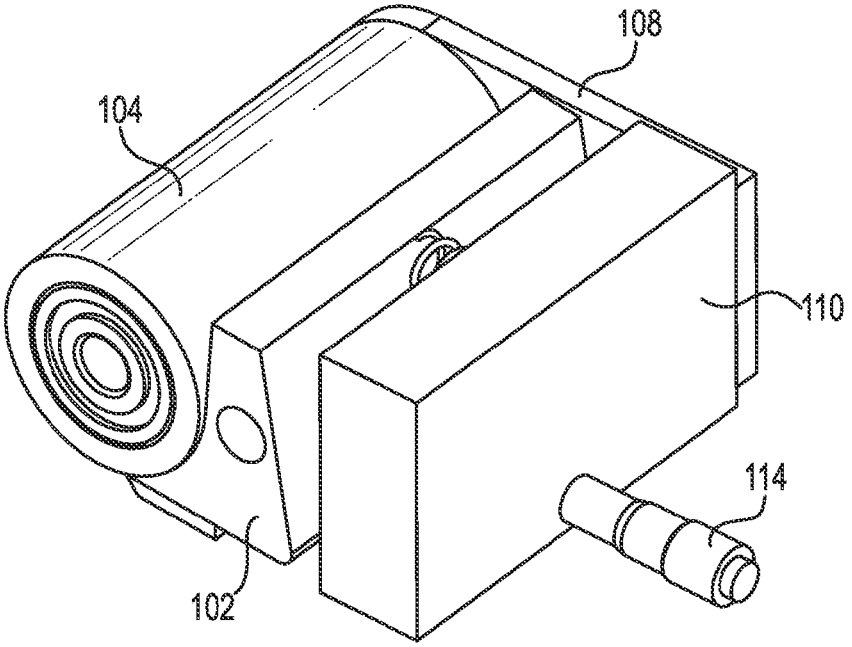
FIG. 2 is a perspective view of an ink fountain apparatus in accordance with certain embodiments of the present invention.
Figure 3:
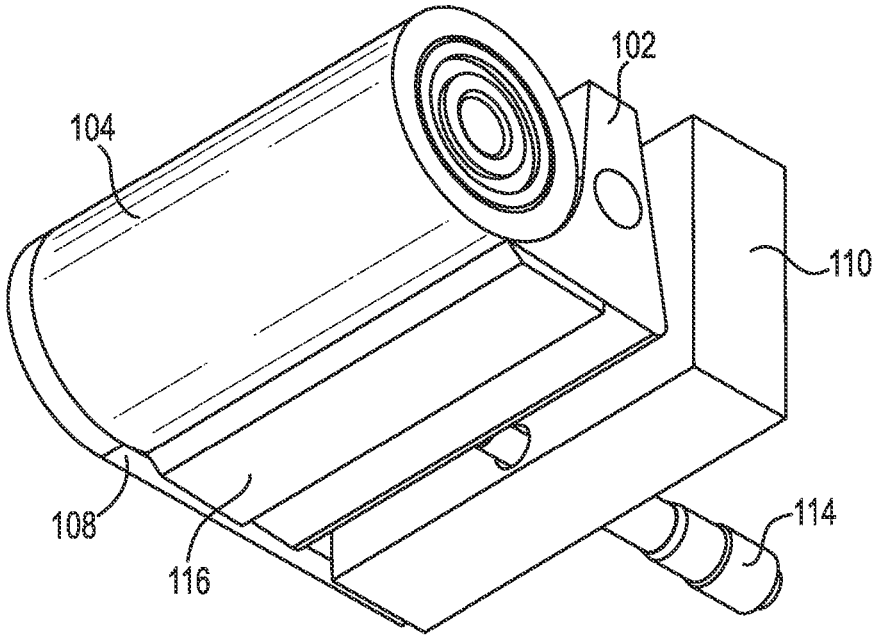
FIG. 3 is a perspective view of an ink fountain apparatus in accordance with certain embodiments of the present invention.
Figure 4:
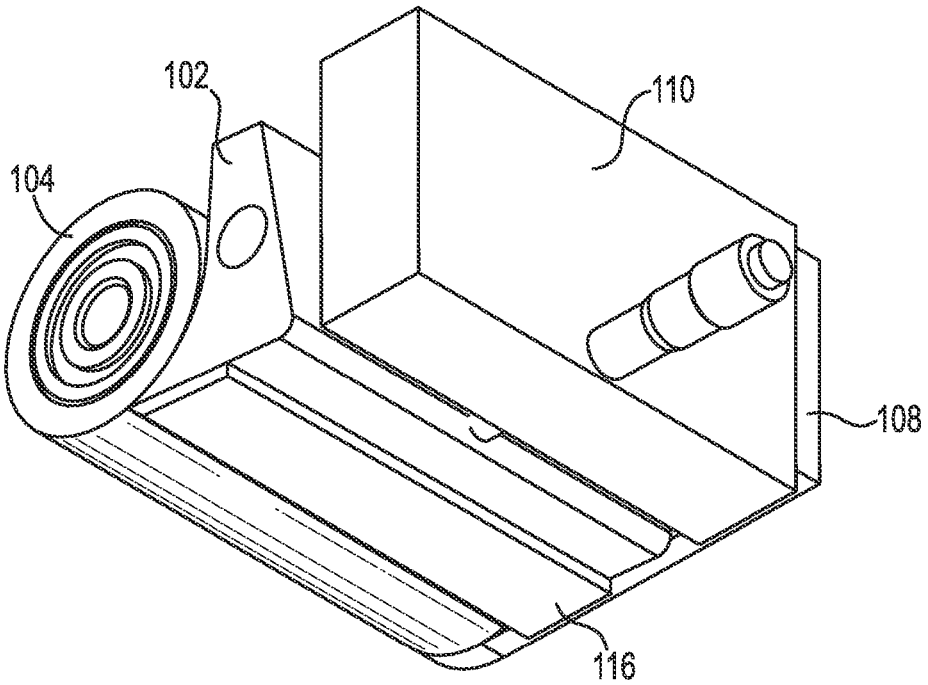
FIG. 4 is a perspective view of an ink fountain apparatus in accordance with certain embodiments of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the invention is to cover all modifications, equivalents, and alternatives falling within the spirit and scope of the invention as defined by the appended claims.

DETAILED DESCRIPTION

In the following descriptions, the present invention will be explained with reference to various example embodiments; nevertheless, these embodiments are not intended to limit the present invention to any specific example, environment, application, or particular implementation described herein. Therefore, descriptions of these example embodiments are only provided for purpose of illustration rather than to limit the present invention. It is understood that the features mentioned hereinbefore and those to be commented on hereinafter may be used not only in the specified combinations, but also in other combinations or in isolation, without departing from the scope of the present invention.

Referring generally to FIGS. 1-7, an ink fountain apparatus 100 comprises an adjustable ink throttle 102 that is spaced apart from the external circumferential surface of an ink transfer roller, anilox roller or a specialized fountain roller 104 to form an ink storage space or gap 106 there between.

The term "roller" is used generally herein to refer to a wide variety of roller types. The roller 104 can be a typical anilox roller in one embodiment. In another embodiment, the roller 104 can be a rubber cylindrical roller or a fountain roller. In a further embodiment, the roller 104 can be a cylindrical roller having a specialized coating with capillary action features defined in the coating. The coating can be rubber, chrome, ceramic, glass, metal or other material that can define the capillary features. The coating can be formed from any conventional means, including spraying, molding, electroplating, etching and machining.

The apparatus 100 further includes a first side plate 108 and a back plate 110. A second side plate is provided to the apparatus opposite the first side plate, but is shown removed in the drawings in order to better illustrate various features of the apparatus. The ink throttle 102 and roller 104 are pivotally or rotationally mounted to the side plates 108 to permit these components to rotate about their respective axes. The axis of rotation of the roller 104 is through its longitudinal center axis. A center rod or axle 105 spans between the side plates 108 and the roller 104 rotates there around. A pivot rod 103 is provided through a sideways aperture through the ink throttle 102 and attaches the to the end plates to permit the throttle part to pivot about the axis through the center of the rod 103. The rod 103 is supported by the end plates 103. The back plate 110 is rigidly secured to the side plates 108 so that is does not pivot.

A resilient means, such as a spring 112 or other compression resistive component, is disposed between the back plate 110 and the rear side of the ink throttle 102. In an alternative, a mechanical or electrical actuator can be used in place of the resilient means (hereinafter referred to as the spring). The spring 112 is disposed vertically above or below the axis of rotation of the throttle. The spring resists pivot forces applied to the rear of the throttle below its axis of rotation.

A throttle position controller 114 is provided to the back plate 110 and engages the rear of the throttle 102 below the throttle's axis of rotation. The position controller is configured to apply a force to the throttle where it is engaged so that the throttle is controllable pivoted about its rotational axis. The combination of this force by the controller 114 and the resistance of the spring 112 allows the throttle to be selectably and securely maintained in a fixed orientation with respect to the roller 104. The resistance spring 112 is useful for low rotational speed operation and low ink pressure applications. However, higher speeds create sufficient hydraulic pressures that the need for spring resistance can be reduced or eliminated. Note that the above/below respective positions of the spring 112 and position controller 114 with respect the throttle's axis of rotation can be reversed without departing from the scope of the invention. While a single controller is shown in the figures, more than one throttle position controllers can be provided to evenly distribute the adjustment forces across the throttle.

The throttle position controller 114 can be configured as either a manual device or an automated device. For example, the adjusting member can be a manual micrometer thimble mounted to the back plate with its extendable member engaging the throttle. Alternatively, the controller device can be a solenoid, electric motor, a pneumatic piston, a hydraulic piston, a piezoelectric actuator, or other suitable means to rotate the throttle. The mechanism of operation can include simple extension/retraction member or pressure-controlled piston, or the mechanism can include a linkage, gears, threads, a cam actuator, a wedge, or a combination thereof. For example, in certain embodiments, a servo motor can be operably engaged with the throttle via a gear train or a belt. The throttle can be locked to its axle and the axle rotated by a motor in other alternatives. The gear train and motor can also be disposed outside of one of the side plates.

An adjustable rigid knife 116 is disposed adjacent the bottom side of the throttle component 102. The knife 116 defines an edge adjacent the exterior surface of the roller 104. The knife 116 is moveable separately with respect to the throttle 102. The adjustment can be provided by the knife translating in a channel defined in the bottom of the throttle or by adjustment slots defined in the knife body. The knife can be secured in place with screws or can be selectively adjustable with an adjustment control mechanism such as one of the adjustment means discussed above with respect to the throttle.

Figure 5:
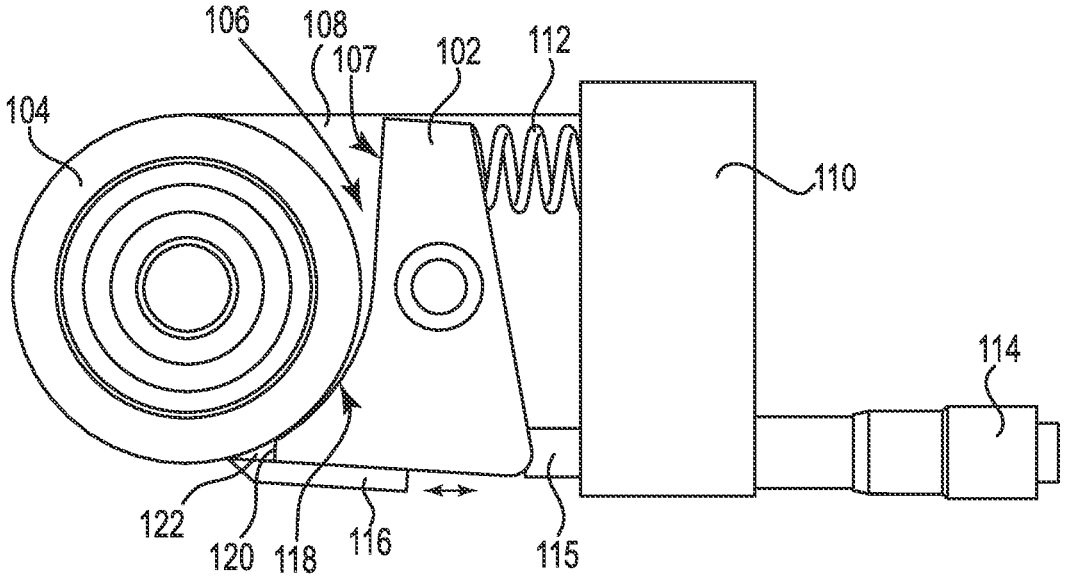
FIG. 5 is a side view of an ink fountain apparatus in accordance with certain embodiments of the present invention.
Figure 6:
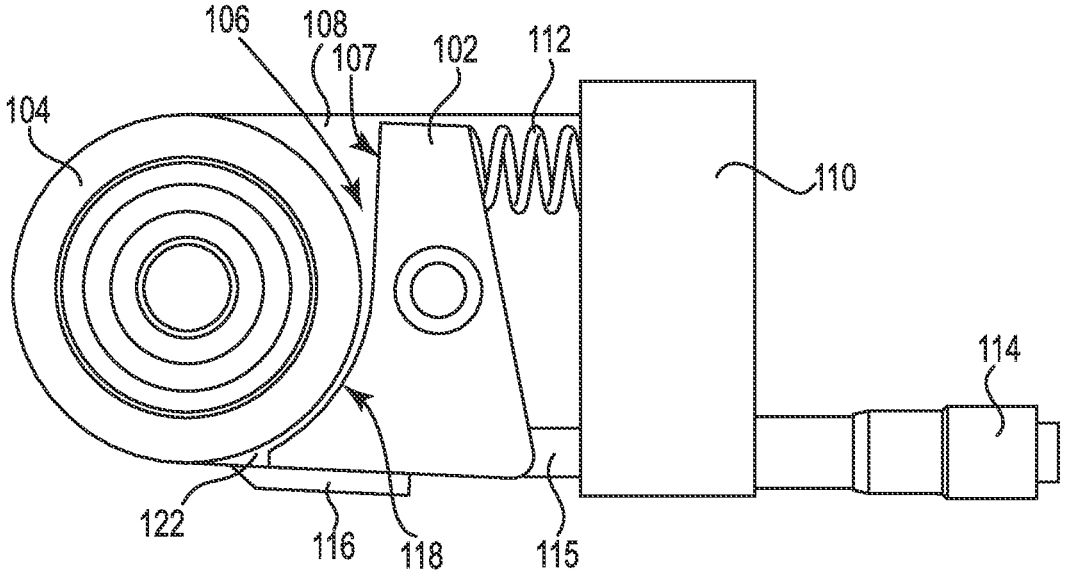
FIG. 6 is a side view of an ink fountain apparatus in accordance with certain embodiments of the present invention.
Figure 7:
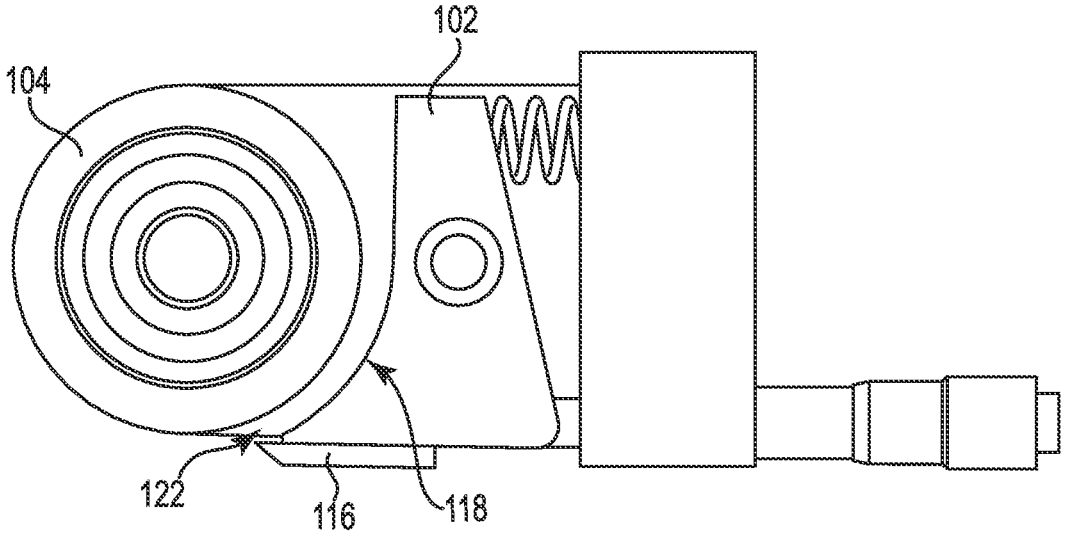
FIG. 7 is a side view of an ink fountain apparatus in accordance with certain embodiments of the present invention.
Figure 8:
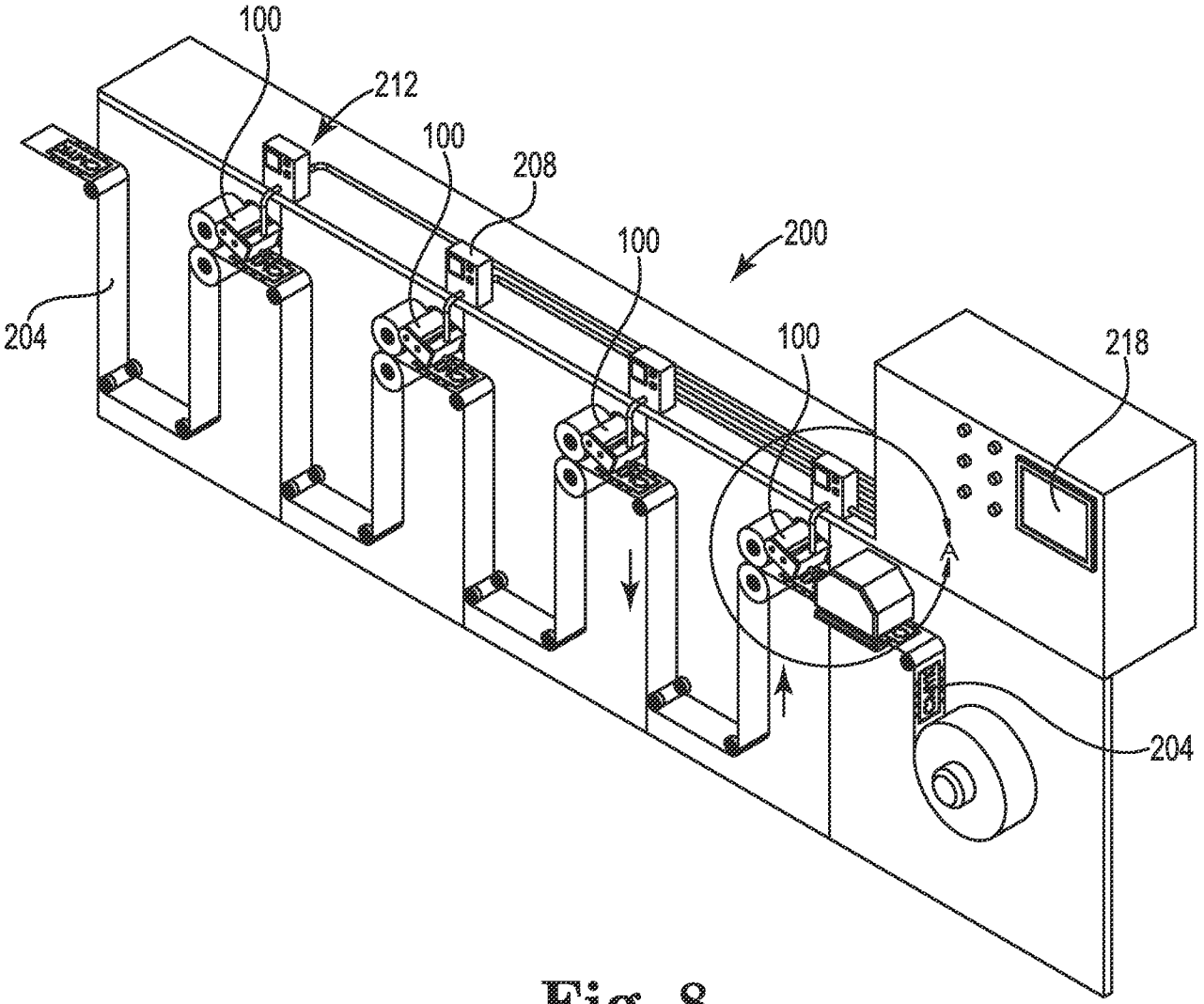
FIG. 8 is a perspective view of a flexographic printing system in accordance with certain embodiments of the present invention.
Figure 9:
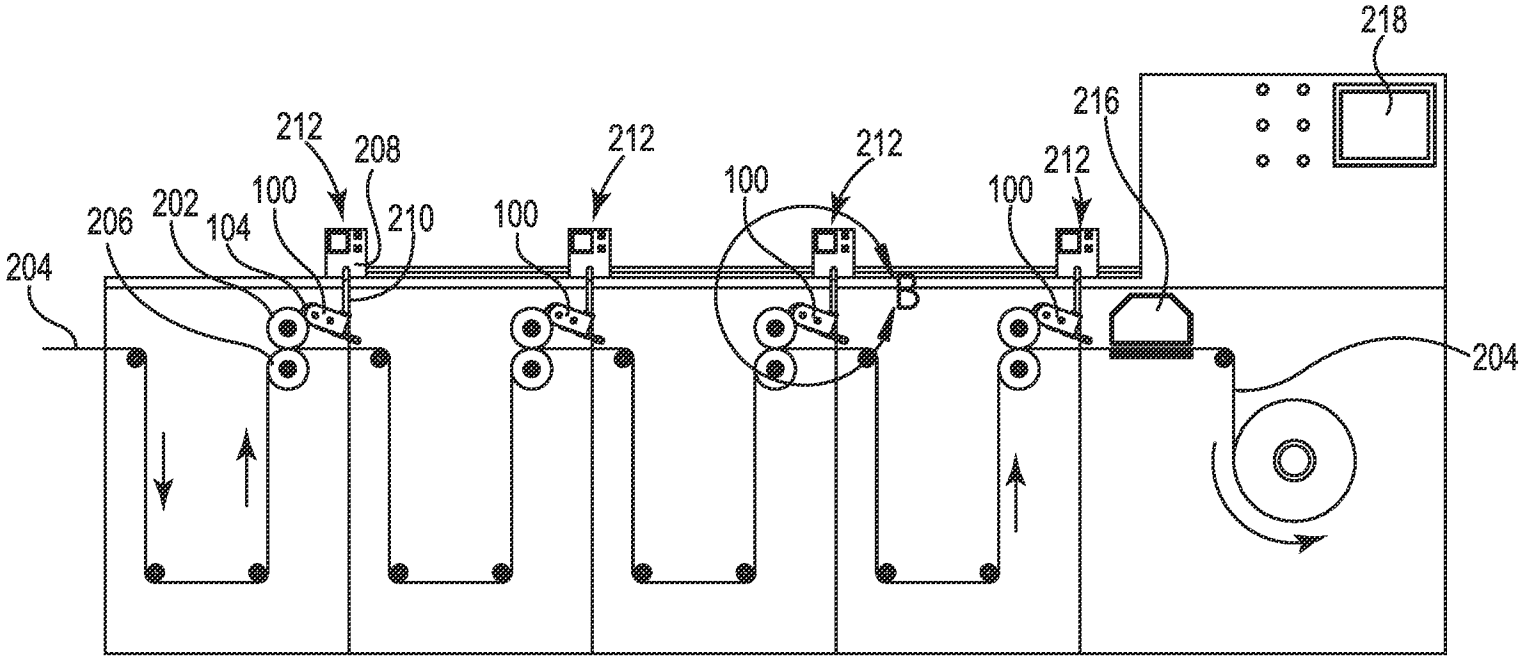
FIG. 9 is a side view of a flexographic printing system in accordance with certain embodiments of the present invention.

As can be seen most clearly in FIGS. 5-7, the front surface 107 of the throttle 102, which faces the roller 104, includes a tapered or curved section 118. The tapered section 118 principally follows the contour of the outer surface of the roller 104 in such a manner as to form a tapering constriction that terminates in a dispensing end 120. This tapered constriction towards the roller's surface produces a laminar flow of ink from the ink storage area 106 onto the surface of the roller 104. The knife 116 in combination with the dispensing end 120 define an ink supply port. The gap formed at the intersection of the knife 116, dispensing end 120 of the throttle 102 and surface of the roller 104 define a manifold 122, which functions as a pressure equalizer/stabilizer for the ink.

The structure of the apparatus 100 discussed above allows the flow of ink to the surface of the roller 104 to be selectably adjusted. By pivoting the tapered portion 118 of the throttle 102 towards the roller, the flow of ink onto the roller will be decreased. Pivoting the tapered portion 118 of the throttle 102 away from the roller will increase ink flow. Also, the manifold size can be adjusted by linearly translating the knife outward towards the roller surface or retracted away from the roller surface (as indicated in FIG. 5) independent of the throttle orientation.

FIG. 5 illustrates the throttle in a minimal ink flow orientation. Note that the extendable member 115 of the throttle position controller 114 is extended, which causes the tapered section 118 of the throttle 102 to move relatively close to the outer surface of the roller 104. The knife 116 is also shown significantly extended towards the roller surface.

FIG. 6 illustrates the throttle in an intermediate ink flow orientation. Note that the extendable member 115 of the throttle position controller 114 is less extended than in FIG. 5. This results in the tapered section 118 of the throttle 102 to be less close to the outer surface of the roller 104 as compared to FIG. 5. Thus ink will flow more freely such that a larger quantity of ink will be deposited onto the roller surface as compared to FIG. 5. Also, it can be seen that the knife 116 is less extended towards the roller surface in this configuration.

By extending or retracting blade 116 relative to body 102, a larger or smaller manifold area can be created. The manifold trims or evens-out fluid pressure before the ink is extruded past blade 116 and on to roller 104. This manifold adjustment allows the device to compensation for the wide range of ink viscosity encountered within the flexographic industry. Also by adjusting the knife opening size, relative to tapered section 118, a maximum/minimum fluid (ink) pressures can be controlled.

FIG. 7 illustrates the throttle in a high ink flow orientation. Note that the extendable member 115 of the throttle position controller 114 is significantly retracted away from the roller surface as compared to either of FIGS. 5 and 6. Thus, ink will flow very freely such that an even larger quantity of ink will be deposited onto the roller surface as compared to FIG. 5. Also, it can be seen that the knife 116 is again relatively retracted.

The throttle position can be varied in any number of increments between a minimum (no ink flow) and a maximum (ink flows so much that ink spills) setting. The number of increments will vary depending on the resolution of the adjustment mechanism employed.

Inks do not always have the same viscosity and the viscosity of a given ink formulation can change during the course of a given run on a press. Therefore, the throttle feature of the present invention is advantageous to allow for the ink volume to the roller to be adjusted so that the desired print qualities can be achieved and maintained without needing to stop a run to change the roller.

In use, ink adheres (by capillary action) to the external tubular surface of the roller 104 that is exposed in the ink exiting the manifold 122. As the roller 104 rotates, a laminar boundary layer of ink on the periphery surface of the roller forms along the tapered surface 118 of the throttle 102. As the roller continues rotating towards the manifold 122, the spacing between the tapered section 118 and the roller surface narrows, thereby offering support to the developing outer boundary layer of the ink.

As the gap spacing continues to constrict, the shear strength of the ink builds pressure within the boundary layer, thereby causing a pressure increase. The pressurized ink then flows into the manifold, which acts as a laminar flow chamber located adjacent the knife edge, allowing ink pressure spikes to stabilize evenly ahead of the knife before the ink is extruded through the adjustable knife edge forming the orifice against the surface of the roller 104. The orifice may be adjusted to increase or decrease the ink volume flow using rotating motion as discussed herein. The movement can be linear, pivotal or complex in alternative embodiments. For example, the throttle can be coupled to a track or other slide means instead of rotationally or pivotally mounted, so that a linear sliding motion towards the roller is provided. Typical gap adjustments can be on the order of microns owing to the rather small magnitude of the orifice size.

The present invention can be used to lay down substances to a substrate other than ink. For example, adhesives and other coatings to the substrate can be applied. The adjustability of the throttle position allows for the volumetric flow to the roller to be such that these substances can to be applied to the substrate in a single pass. Currently, the conventional technology usually requires the substrate to receive a double or multiple pass application of adhesives and coatings. This is both expensive and time consuming.

In one embodiment, the throttle 102 and knife 116 are continuous across their entire widths. In an alternative, the width comprises a plurality of individual side-by-side throttles/knives that can each be individually controlled. In this embodiment, the inking of the fountain roller can be altered in independent segments across the roller's width to better fine-tune the printing characteristics.

In use, the ink fountain apparatus 100 can be used as a fountain roller apparatus as part of a printing press system, which will be described below in more detail. Alternatively, the ink fountain apparatus 100 can be integrated with both hand-operated and automated proofing devices and systems, such as those disclosed in US Pat. App. Pub. No. 2013/0000501, which is hereby incorporated by reference in its entirety herein. In a proofer system, the ink fountain apparatus 100 replaces the anilox roller or ink transfer roller.

Referring to FIGS. 8-11, the ink fountain apparatus 100 is integrated into a printing press system 200. In particular, a flexographic printing press system is shown. In such system, the roller 104 is in contact with an image plate roller 202 having a flexographic plate adhered to its outer circumferential surface. The plate contacts the inked roller 104 as the plate roller 202 kisses or ink roller 104, thereby transferring ink to the plate. The image plate also contacts a substrate 204 as the plate roller 202 turns, thereby creating an image on the substrate. An impression cylinder 206 provides upward pressure on the substrate 204 as the plate roller rotates in order to support the substrate at the point where the plate contacts the substrate. Ink is supplied to the ink fountain apparatus 100 by an ink dispenser 208. An ink conduit 210 feeds the ink from the dispenser to the ink storage area 106 of the ink fountain apparatus 100.

The combination of the ink fountain apparatus 100, image plate roller 202, impression cylinder 206 and ink meter 208 define an ink station 212. A given printing system typically includes four ink stations 212. However, more or fewer numbers of stations 212 can be provided without departing from the scope of the invention. Each station corresponds to a single color ink. For example the four stations may be cyan, magenta, yellow, and black. The substrate 204 is fed (as indicated by the arrows in FIG. 9) through each of the color stations 212 where a respective ink is deposited on the substrate. Thus, the desired image is formed on the substrate after application of the last ink station.

Figure 10:
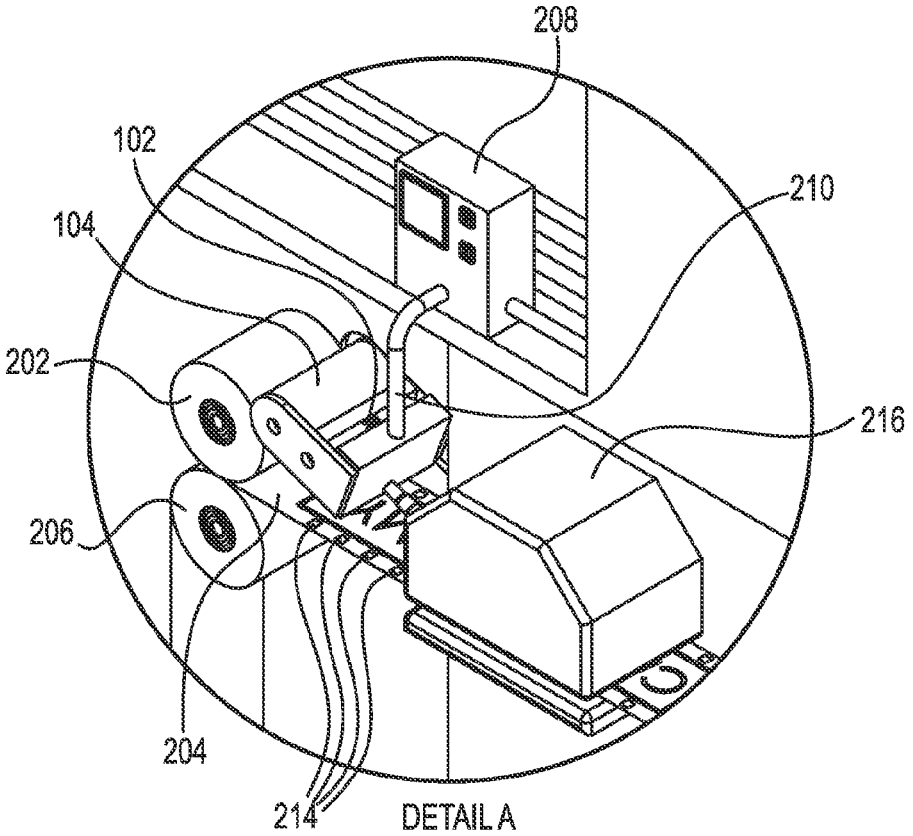
FIG. 10 is a view of detail A indicated in FIG. 8 in accordance with certain embodiments of the present invention.
Figure 11:
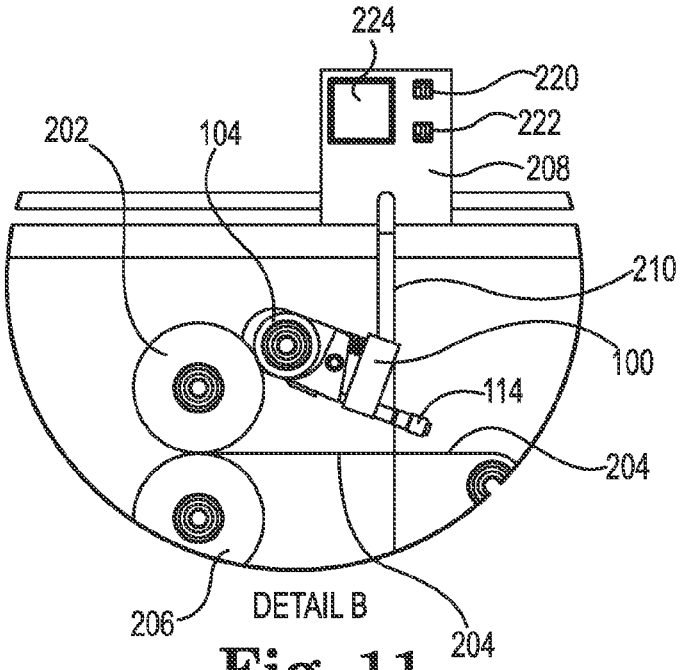
FIG. 11 is a view of detail B indicated in FIG. 9 in accordance with certain embodiments of the present invention.

It is desirable, of course, for the image quality on the substrate to meet certain quality parameters as are known in the art. A typical parameter is color density. In order to quantify the quality parameters of the image, each color station deposits a respective test image 214, as can be seen in FIG. 10. Each of these test images 214 passes through a scanner apparatus 216 that optically reads the respective test images and outputs the results to the operator, such as on press control monitor 218. The results can also be outputted to any computing apparatus or display networked to the printing system 200. In addition, the measured results can be stored in a computer database for later recall and review.

The real-time feedback of the performance of each color station's quality measurements allows the measured values to be compared to the desired or pre-determined quality measurements to confirm that the image quality is within expectations, both before and during a run. The monitoring and comparison can be performed manually, or it can be performed automatically by a comparison algorithm programmed in the non-transitive memory for the processor controlling the press operation. If automated, a notification (audio and/or visual) can be provided to the operator to take action.

When a color is found to be deviated from expected measurements, the individual station 212 can be adjusted as necessary. In particular, the throttle position controller 114 is adjusted in order to increase or decrease ink flow until the actual measurements resolve with the pre-determined specification.

The adjustment of the throttle position controller 114 can be automated as discussed previously. In FIGS. 8-11, the controls for the automated adjustment are provided on the housing for the ink meter 208. In particular, buttons for increasing 220 and decreasing 222 ink flow are provided. A readout screen 224 is provided to indicate an ink flow metric so that the operator can be provided with an ink flow value.

Figure 12:
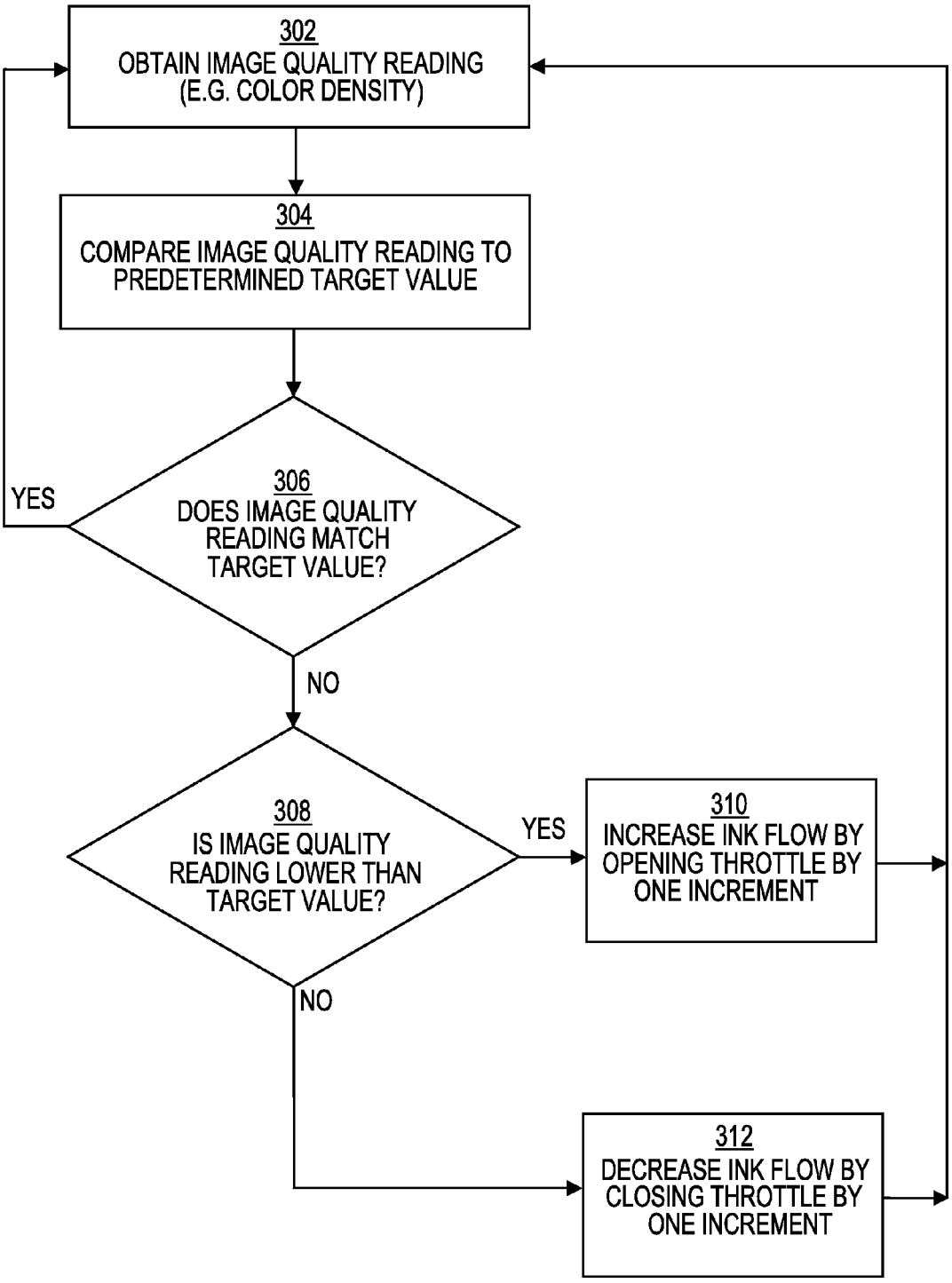
FIG. 12 is a flowchart for an ink flow adjustment algorithm according to certain embodiments of the present invention.

In a further embodiment, the ink flow adjustment of each ink station 212 is controlled automatically by a computer executing a program stored in its memory. In particular, the press control computer mentioned previously can be further programmed with an algorithm that automatically adjusts the ink flow rates for each ink station to maintain specified parameters. Referring more particularly to FIG. 12, an adjustment algorithm for a given ink station is shown. Note that this algorithm is performed by the processor for each color station.

In step 302, the processor obtains a measured quality reading (e.g. color density) from the scanner 216 or from memory. The reading is queried with a set frequency, such as once per second, or every set number of clock cycles of the processor, or at a set fractional percentage of the speed at which the press is running.

Next, in step 302, the processor compares the measured quality reading to the specified or predetermined desired reading set by an operator or by the computer that formed the plate. Each plate has an optimum designed color density and the processor controlling the printing apparatus can be networked with the computer-controlled device that creates the flexographic printing plates to automatically receive the predetermined desired settings for the color quality parameters.

In step 306, if the reading is found to be within specification, then the computer obtains the next reading at the specified periodicity. But if the reading in not within specification, then the computer determines whether the reading is too low 308. If color density is too low, then the computer in step 310 increases ink flow by opening the ink throttle 102 of the respective ink station by one increment. If color density is not too low, then it must be too high. Thus, the computer goes to step 312 where it decreases ink flow by closing the ink throttle 102 of the respective ink station by one increment. After performing the incremental movement of the throttle, the computer returns to step 302 to obtain a next measured reading. The adjustment algorithm is then continually repeated for the duration of the run. Note that the specified or target value can be either a specific reading, or it can be a range of reading values.

In an additional embodiment, the software code can additionally include code to ensure that the throttle will not be opened or closed beyond pre-set limits, which might lead to damage to the equipment or spilling of ink. The throttle can define an adjustment value relative to a fully closed position. Thus the throttle position can be read by the processor every time the throttle is incremented or de-incremented. This reading is then checked against the pre-set limits for the throttle travel. If the travel will be exceeded either below or above the pre-set range, then the throttle change will not be performed, and an alarm and/or warning will be provided to the press operator.

In another aspect, the printer control computer is programmed for certain print quality characteristics, such as desired color density, prior to beginning a given run. The print setup can even be downloaded or transmitted to the printer from a remote location, such as in the ink lab where a proofer according to the present invention is used to determine the setup values, or by the plate fabrication system determines the optimum color density for the run, or some combination of the preceding. The operator then simply loads the ink in the ink meters, mounts the plates on the plate cylinders, feeds the substrate, and starts the print run. The computer then automatically adjusts the ink as discussed above to achieve the pre-set characteristics. Thus, the operator need not be as highly skilled, trained or experienced as compared to operators of conventional printing systems.

Certain embodiments provide various benefits. For example, a single roller can replace a large bank of conventional anilox rollers because the ink flow is adjustable. This adjustability also provides an increased lifespan of a given roller well past its rated value. Normal anilox roll wear can be compensated for by increasing the flow of ink to match the roller's rated value, thereby extending the useful anilox life. Higher flow rates may be attained than with conventional anilox technology because the invention is not limited to the psychics of cell and line count limitations, making single pass white coat possible. The use of one universal fountain roll eliminates frequent anilox roll change over. The knife edge is not in mechanical contact with the fountain roll, which will extend the life of the fountain roll. Non-ceramic surfaces may be used providing a more durable work surface. Ink spitting is also reduced.

The ink roller is eliminated. This reduces component cost while reducing gear noise from the ink roll. Also the conventional open ink well is eliminated, which reduces ink deterioration from additive evaporation.

In other aspects, the coating on the roller surface can be selected to optimize performance when using specialized inks.

The present invention also allows for printing components to be cleaned in place. In other words, the components can be cleaned without needing to remove them and re-assemble.

Unless specified herein, the various components of the fountain apparatus can be formed of suitable metal alloys as is known in the art.

In further examples, the dipping process of the photopolymer plate into the film coating on the roller produces a better dot shape than the current process that presses the plate into the anilox roller.

The present invention may be embodied in other specific forms without departing from the spirit or essential attributes thereof, and it is, therefore, desired that the present embodiment be considered in all respects as illustrative and not restrictive. Those skilled in the art may recognize other equivalents to the specific embodiment described herein which equivalents are intended to be encompassed by the claims attached hereto.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. An ink fountain apparatus, comprising:

a side plate;

a roller disposed adjacent a first end of the side plate;

a back plate disposed adjacent a second opposing end of the side plate;

a throttle disposed between the roller and the back plate, the throttle being rotatably mounted to the side plate and defining an axis of rotation, the throttle including a back surface facing towards the back plate and a front surface facing towards the roller, the front surface including a curved portion;

a resilient member disposed between the throttle and the back plate; and a position controller coupled to the throttle to selectively pivot the curved portion towards and away from the roller.

2. The ink fountain apparatus of claim 1, wherein the position controller engages the back surface of the throttle at a point vertically below the axis of rotation of the throttle.

3. The ink fountain apparatus of claim 1, wherein the position controller engages the back surface of the throttle at a point vertically below the axis of rotation of the throttle and the resilient member engages the back surface of the throttle at a point vertically above the axis of rotation of the throttle.

4. The ink fountain apparatus of claim 1, wherein the throttle includes a bottom surface, and the apparatus further comprises a knife member disposed along the bottom surface of the throttle, the knife member being movable towards and away from the roller independently from the throttle position.

5. The ink fountain apparatus of claim 4, wherein a proximal end of the curved portion and a proximally protruding portion of the knife member define a manifold area.

6. The ink fountain apparatus of claim 1, wherein the front surface of the throttle further includes a planar portion that intersects the curved portion.

7. An ink fountain apparatus, comprising:

a frame member;

a roller coupled to the frame member;

a throttle coupled to the frame member, the throttle including a front surface facing towards the roller, the front surface including a planar portion and a curved portion, wherein gap is formed between the roller and the front surface of the throttle; and a position controller coupled to the throttle to selectively move the throttle to alter a dimension of the gap.

8. The ink fountain apparatus of claim 7, wherein the throttle is rotatably coupled to the frame member.

9. The ink fountain apparatus of claim 7, wherein the throttle is pivotally coupled to the frame member.

10. The ink fountain apparatus of claim 7, wherein the frame member includes a side plate and a back plate, the throttle further defining a rear surface facing the back plate, the apparatus further including a resilient member disposed between the throttle and the back plate.

11. The ink fountain apparatus of claim 7, wherein the frame member includes a back plate, the ink fountain apparatus further comprising a resilient member disposed between the throttle and the back plate.

12. The ink fountain apparatus of claim 7, wherein the position controller engages a back surface of the throttle to rotate the throttle about an axle.

13. The ink fountain apparatus of claim 7, wherein the throttle includes a bottom surface, and the apparatus further comprises a knife member disposed along the bottom surface of the throttle, the knife member being movable proximally towards and distally away from the roller independently from a position of the throttle.

14. The ink fountain apparatus of claim 13, wherein a proximal end of the curved portion and a proximally protruding portion of the knife member define a manifold area.

15. The ink fountain apparatus of claim 7, wherein the gap is configured to create a laminar flow of ink through the tapered gap.

16. An ink fountain apparatus for applying a volume of ink flowing to a photopolymer plate, the ink fountain apparatus comprising:

a frame member;

a roller coupled to the frame member, the roller including an outer cylindrical surface;

a throttle coupled to the frame member, the throttle including a front surface facing towards the outer cylindrical surface of the roller and a rear surface, the front surface including a curved portion; and a throttle position controller engaging the rear surface to selectively move the throttle relative to the roller.

17. The ink fountain apparatus of claim 16, wherein the throttle position controller is manually operable.

18. The ink fountain apparatus of claim 16, wherein the front surface of the throttle is shaped such that a laminar flow of ink is provided onto the outer cylindrical surface of the roller at a terminal end of the curved portion of the front surface of the throttle.

19. The ink fountain apparatus of claim 16, wherein the front surface of the throttle further includes a planar portion that intersects the curved portion.

* * * * *